United States Patent [19]

Reineke

[11] 4,111,125

[45] Sep. 5, 1978

[54] STAYED GROUND MINE, ESPECIALLY FOR RIVERS

[76] Inventor: Horst Reineke, Rosental 14, 53 Bonn, Germany

[21] Appl. No.: 75,032

[22] Filed: Sep. 25, 1970

[51] Int. Cl.[2] ..... F42B 22/04

[52] U.S. Cl. ..... 102/18 R; 102/10

[58] Field of Search ..... 102/8, 10, 16, 18, 19.2

[56] References Cited

U.S. PATENT DOCUMENTS

| | | | |
|---|---|---|---|
| 1,491,004 | 4/1924 | Duff ie | 102/18 |
| 2,752,615 | 7/1956 | Parker | 102/10 X |
| 2,826,990 | 3/1958 | Gross | 102/8 |
| 3,151,555 | 10/1964 | Sellman | 102/10 |
| 3,195,460 | 7/1965 | Kalaf | 102/16 |
| 3,329,091 | 7/1967 | Angelos | 102/19.2 X |

*Primary Examiner*—Charles T. Jordan
*Attorney, Agent, or Firm*—Walter G. Finch

[57] ABSTRACT

An anchored land mine is provided, especially for use in rivers. It consists of a disc-shaped explosive body, together with a fuze device which is formed as an integral individual part with a banding for fastening to an explosive charge. The fuze device also contains a propagation charge which is positioned next to a thin partition of a housing of the fuze device and adjacent to an explosive charge.

10 Claims, 4 Drawing Figures

FIG. 1
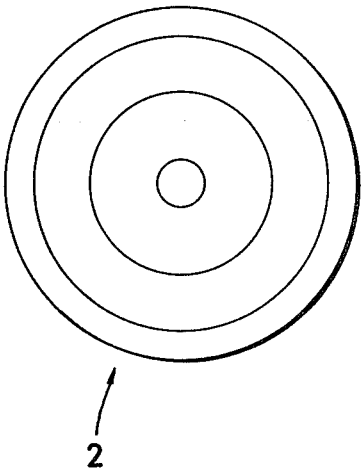
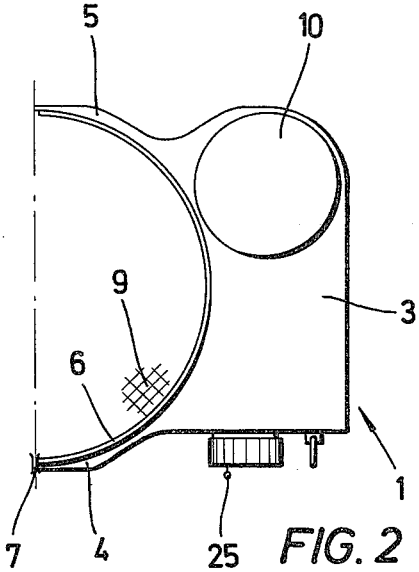
FIG. 2
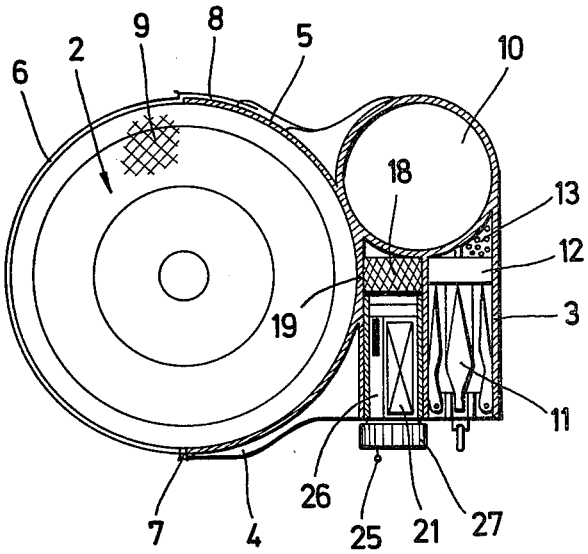
FIG. 3
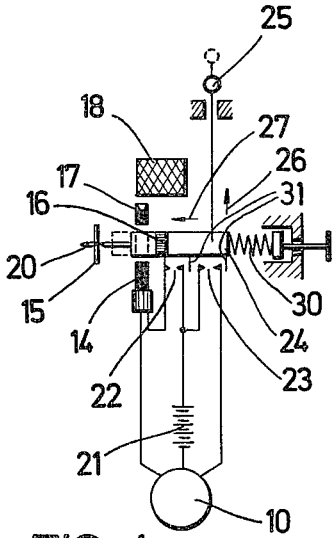
FIG. 4

STAYED GROUND MINE, ESPECIALLY FOR RIVERS

This invention relates generally to demolition devices, and more particularly to an anchored land mine consisting of a disc-shaped explosive charge and a remote control fuze device for use especially for rivers.

Underwater mines which after being submerged in a lake or river are carried away by the stream until they strike an object which explodes them on contact. Such mines are well known. This kind of fusing frequently leads to accidental triggering and to a high consumption of these kinds of mines.

In well known types of construction of an underwater mine, the flat, disc-shaped explosive charged is girded around this circumference by a flexible wire or something similar from which radially directed wires or rods lead to a fuse device arranged in the middle of the explosive charge, where the disc-shaped spheres running radially to the outside go out from the bracing wire which girds the explosive charge.

The underwater mine is laid out in such a way that it floats in a vertical position so that it does not come in contact with the ground.

In addition, heavy and expensive land mines are also known which are positioned on the ground where the triggering of the fuse is accomplished by means of suitable sensors which react to ultrasonic or electromagnetic, inductive or acoustic signals. Such mines are heavy, technically complicated, and expensive.

It is an object of this invention to provide an anchored land mine with a disc-shaped explosive charge and a remote-control fuse device which remains simple in construction, easy to mount, and relatively cheap to manufacture.

According to the invention, the anchored land mine is distinguished by the fact that the fuse device which is made as an integral individual part is provided with a clamp for fastening it to the explosive charge and that it contains a propagation charge lying next to the thin partition of the fuse-device housing adjacent to the explosive charge.

Therefore, the explosive charge and the underwater fuse device form two independent parts which can be put together before the land mine is laid. For this reason a land mine or an ordinary tank mine can be connected with the fuse device by means of clamps and used as the explosive charge. The exploding propagation charge penetrates the thin partition of the fuse device and causes the explosive charge to explode. Mechanical connection by means of tension band and clamps join the explosive charge and the underwater fuse device which is an independent part in itself. Thus electrical or additional mechanical devices to trigger the explosive charge are not necessary.

The fuse device is most advantageously formed as a flat part with two arms touching the edge of the disc-shaped explosive charge. The connecting device can consist of a band which can tighten around the axis of a hinge by means of a locking clamp. An enveloping net can be fastened between the arms of the fuse device and the tension bands and around the explosive charge.

Without the explosive charge, the fuse device needs little room, so that it can be transported and stored without difficulties. The tension band can be fastened to parts of the fuse device which appropriately stand out at the sides and it is tilted inward toward the body of the fuse when no explosive charge is to be connected. In this way the outside dimensions of the fuse device have been kept approximately to the size of one land mine with one half of an explosive charge.

In another form of the invention, a spread anchor and a removable hand safety are found in the housing of the fuse device. The spread anchor is connected by an anchor line; and the familiar removable hand safety is for setting a fuse device. The removable hand safety is calibrated and the safety status can be read through a viewing port. In addition, the hand safety can be provided with a stopper which prevents triggering by hand at two stages.

A fuse device can be fitted with a sensor with such a directional characteristic that underwater sonic signals striking at either side of the disc can be picked up. It therefore does not matter on which side the mine settles on. In either case the sensor on the upper side of the mine catches the signals as they arrive.

When the hand safety is removed a timing circuit is necessarily released. The timing circuit is connected to a setting device which moves one of the primers of the fuse chain into the sphere of the explosive charge fuse or another adjacent primer charge. The timing circuit can be outfitted with a switch which closes at least one electric switch after it runs down. The switch connects a current source to the explosive charge fuse through the sensor. After the timing circuit has run out, the sensor is connected electrically to the current source.

Other objects and attendant advantages of the invention will become more obvious and apparent from the accompanying drawings and detailed specification in which:

FIG. 1 shows an explosive charge;

FIG. 2 shows a fuse device without an explosive charge and with a tension band clamped inward;

FIG. 3 shows a partial section through a land mine; and

FIG. 4 shows a schematic presentation of the fuse chain and its control.

Referring now to FIGS. 1 and 2, the land mine depicted consists of the underwater fuse device 1 and the explosive charge 2. The explosive 2 depicted in FIG. 1 is disc-or-plate-shaped and has a circular cross section. Other forms are possible within the framework of this discovery which deviate from the design model depicted.

The underwater fuse device 1 likewise represents a flat component whose basic form can be recognized in FIG. 2 and FIG. 3. The housing 3 of the fuse device 1 is provided with arms 4 and 5 which project to the side. These arms form a semicircle which corresponds to the radius of the explosive charge 2.

A tension band 6 is fastened to the arms 4 and 5 and also to explosive charge 2 and fuse device 1 and is pressed against housing 3. Tension band 6 is connected flexibly to the end of arm 4 while the tension is applied through locking clamp 8 at arm 5.

For purposes of storing or transporting fuse device 1, the tension band 6 is tilted inward around the axis of hinge 7 in the manner shown in FIG. 2 so that the outside dimensions of the fuse device are defined by the semicircular projecting arms 4 and 5.

A net 9 which covers both surfaces of explosive charge 2 comes over the tension band. When laying river mines, it can happen that two mines lie directly adjacent to one another. When one of the two mines is detonated, the explosive charge of the adjacent mine which has not been triggered by the fuse device can break up into individual fragments which can then be swept away by the current. This sweeping away is hindered by the net 9 which is laid around the explosive charge. Even should the explosive charge of a mine break up as a consequence of shock waves, the resulting fragments would be held together so that the explosive effect remains intact.

In housing 3 of the fuse device 1, there is a sensor 10 with a directional characteristic which is effective in the direction of the lines normal to the discs of explosive charge 2 in both directions. Sensor 10 has been formed in the usual way as in ultrasonic sensor.

One of the two circular receding organs is visible in FIG. 2 and the other one lies on the opposite side in the representation according to FIG. 2.

Referring now to FIGS. 3 and 4, in addition, a spread anchor 11 with an anchor line 13 is found in a cylindrical chamber 12 of the housing 3. The anchor 11 is pulled out of housing 3 before the mine is laid, and the individual anchor claws are opened radially by springs. When the ground is reached the anchor is made fast and the mine lies flat. The anchor line 13 is connected fast with one end on the anchor and the other end on housing 3.

Detonation of the explosive charge is triggered through sensor 10 through a fuse chain. The fuse chain consists of an explosive charge fuse 14 which is started electrically, the primer charge 16 which is adjustable by means of a timing circuit 15 and 24, a hollow charge 17 and a propagation charge 18. Parts 14–18 of the fuse chain are lined up when the mine is armed in such a way that they have a mutual effect on one another and when explosive charge fuse 14 is triggered, the primer charge 16 is then exploded which in turn ignites the stronger hollow charge 17. The explosion of hollow charge 17 then also detonates the propagation charge 18 which in turn effects the explosive charge 2 through the thin partition 19 of housing 3 and the mine is exploded.

In the safe position, primer charge 16 does not lie within the direct sphere of explosive charged fuse 14 so that the fuse chain is interrupted in any case. This is achieved by a parallel shifting of primer charge 16 at right angles to axis 20 or conversely, by turning around this axis.

When timing circuit 15 and 24 run out, primer charge 16 is shifted in such a way that it comes into alignment with explosive charge fuse 14 and charge 17 so that it explodes when explosive charge fuse 14 is electrically ignited. The timing circuit consists of bolt 24 which, with its tip, is directed at a substance which slowly gives with pressure. However, other timing circuits such as a clock work can be used.

The power supply of the fuse device including sensor 10 is provided through current source 21, a battery. Two circuits are provided, in one of which the starting switch of sensor 10 lies in series with explosive charge fuse 14 and the contact switch 22. The other circuit provides the power supply for sensor 10 and it is switched in by means of contact switch 23. The two switches 22 and 23 are simultaneously closed after the timing circuit has run out, e.g., by means of the movement of bolt 24 and carrier 31, at the end of which primer charge 16 is also connected.

Bolt 24 is spring loaded by means of spring 30 which is adjustable from the outside. It has a notch or lenticulation which hand safety 25 seizes in the manner of a pawl. When hand safety 25 is moved in the direction of arrow 26, spring 30 is released so that the bolt 24 is forced in the direction (arrow 27) of the firm plastic mass which it penetrates until switches 22 and 23 are closed and primer charge 16 has become aligned in the fuse chain.

At this moment, sensor 10 is switched in through switch 23 and the electrical explosive charge fuse 14 becomes effective through switch 22. It can act on primer charge 16 since the latter now lies within the effective sphere of explosive charge fuse 14. By pulling hand safety 25, the timing circuit 15 and 24 begins to operate and primer charge 16 is displaced so that after the set time has expired it is positioned so that explosive charge fuse 14 can act on the primer charge. The parts depicted in FIG. 4 are housed in the sealed space 26 of housing 3, and this sealed space is closed with watertight locking screw cap 27.

Housing 3 has been kept flat and its vertical dimensions are such that it corresponds to the thickness of explosive charge 2, e.g., of a tank mine. In this way the complete river land mine will not undergo any rolling motion on the riverbed when it is laid, and each time will take up a position lying on the riverbed on one or the other of its two flat sides.

It can, therefore, not be detected with sonar instruments. Sensor 10 can be formed as a floating body which can be released from the land mine in the flat position and it is then only connected to it with a lead. This must be done in such a way that the floating body can be released from both sides.

In order that a mine once armed can be immediately recognized, it can be provided with a marking behind a viewing port which shows the safety status. It is best to have this coupled with a hand release. If the hand release has been pulled, then the mine must be handled with care so that the hand release cannot be reinserted and thus give the appearance that the mine is not armed. The arming is, therefore, provided with a lock which prevents a second arming.

In order to prevent a possible accidental release of the mine to go unnoticed, the arming can be provided with a locking device which produces an acoustic signal when released. This can consist of a bolt which is spring loaded and which strikes against a baffle place when released and in this way causes an appropriate noise.

Obviously many modifications and variations of the present invention are possible in light of the above teachings. It is, therefore, to be understood that within the scope of the appended claims the invention may be practiced otherwise than as specifically described.

What is claimed is:

1. An anchored mine, comprising, a disc-shaped explosive body, a housing having a fuze device with a propagation charge for said explosive body consisting of a thin partition lying at the edge of said explosive body, said housing having attached thereto two arms for encompassing a portion of said disc-shaped explosive body, a banding device for encompassing and fastening said explosive body to said fuze device, said banding device consisting of a band, hinge means for connecting one end of said band to one of said arms, and clamp means for tensioning said band and locking the other end of said band to the other arm of said two arms, said fuze device being positioned next to said thin partition and adjacent to said explosive body.

2. An anchored mine as recited in claim 1, and additionally net means provided between the arms of said fuze device and said banding device and which is positioned around the explosive body.

3. An anchored mine as recited in claim 1, and additionally a spread anchor having an anchor line positioned in said fuze device, and a removable hand safety for arming said fuze device.

4. An anchored mine as recited in claim 3, and additionally a viewing port in said fuze device, and markings which can be seen through said viewing port and which show the safety status of said removable hand safety.

5. An anchored mine as recited in claim 4, and additionally a stopper which prevents the removable hand safety from being released twice.

6. An anchored mine as recited in claim 3, and additionally a locking device which creates an acoustic signal when said removable hand safety is released.

7. An anchored mine as recited in claim 1, and additionally a sensor in said fuze device with such directional characteristics that it picks up underwater sonic signals which strike the mine vertically on either side of said disc-shaped body.

8. An anchored mine as recited in claim 7, and additionally a setting device, a primer charge in said fuze device, a removable hand safety for arming said fuze device, and a timing circuit which is released by said removable hand safety and which is connected with said setting device, said setting device transporting said primer charge of said fuze device into the sphere of influence of an explosive charge fuze in said fuze device.

9. An anchored mine as recited in claim 8, a switch, a current source, with said timing circuit being provided with a switching device which closes said switch when it runs down, in which case said switch connects said explosive charge fuze to said current source through said sensor.

10. An anchored mine as recited in claim 8 a current source, and a switch which connects said sensor electrically to said current source after said timing circuit runs out.

* * * * *